US008991475B2

(12) United States Patent
Klima

(10) Patent No.: US 8,991,475 B2
(45) Date of Patent: Mar. 31, 2015

(54) CHECKER BRICK WITH THROUGH PASSAGES FOR A HOT BLAST STOVE

(75) Inventor: Alexander Klima, Wiesbaden (DE)

(73) Assignee: Paul Wurth Refractory & Engineering GmbH (DE)

( * ) Notice: Subject to any disclaimer, the term of this patent is extended or adjusted under 35 U.S.C. 154(b) by 990 days.

(21) Appl. No.: 12/918,540

(22) PCT Filed: Dec. 24, 2008

(86) PCT No.: PCT/EP2008/068282

§ 371 (c)(1),
(2), (4) Date: Aug. 20, 2010

(87) PCT Pub. No.: WO2009/106186

PCT Pub. Date: Sep. 3, 2009

(65) Prior Publication Data

US 2010/0326621 A1 Dec. 30, 2010

(30) Foreign Application Priority Data

Feb. 28, 2008 (EP) ..... 08152069

(51) Int. Cl.
*F23L 15/02* (2006.01)
*C21B 9/02* (2006.01)
*C21B 9/10* (2006.01)

(52) U.S. Cl.
CPC .... *C21B 9/02* (2013.01); *C21B 9/10* (2013.01)
USPC ..... 165/9.1; 165/9.2; 165/9.3

(58) Field of Classification Search
USPC ..... 165/9.1, 9.2, 9.3
See application file for complete search history.

(56) References Cited

U.S. PATENT DOCUMENTS

| | | | | | |
|---|---|---|---|---|---|
| 1,173,187 | A | * | 2/1916 | Hechenbleikner | 165/9.1 |
| 1,307,635 | A | * | 6/1919 | Nielsen | 261/95 |
| 2,017,763 | A | | 10/1935 | Mamula | |
| 2,172,714 | A | * | 9/1939 | Schack et al. | 165/9.1 |
| 2,833,532 | A | * | 5/1958 | Ries | 165/9.1 |
| 3,220,715 | A | * | 11/1965 | Kinney | 165/9.4 |
| 3,436,064 | A | * | 4/1969 | Sheatsley et al. | 165/9.1 |
| 3,549,136 | A | * | 12/1970 | Blackwood et al. | 165/9.4 |
| RE27,020 | E | * | 1/1971 | Hauth et al. | 165/9.4 |
| 3,591,153 | A | * | 7/1971 | Powell et al. | 165/9.3 |
| 3,918,517 | A | * | 11/1975 | Silverstone et al. | 165/10 |
| 4,075,812 | A | * | 2/1978 | Koyama et al. | 165/9.1 |

(Continued)

FOREIGN PATENT DOCUMENTS

| | | |
|---|---|---|
| FR | 1096652 | 6/1955 |
| GB | 994833 | 6/1965 |

(Continued)

OTHER PUBLICATIONS

International Search Report PCT/EP2008?068282; Dated Apr. 1, 2009.

*Primary Examiner* — Ljiljana Ciric
(74) *Attorney, Agent, or Firm* — Cantor Colburn LLP

(57) ABSTRACT

A checker brick (10) with through passages for a hot blast stove has a top surface (12) and an opposite bottom surface (14) with a plurality of through passages (16) extending from the top surface (12) to the bottom surface (14). The through passages (16) allow fluids to circulate through the checker brick (10). Partition walls (18) are formed between neighboring through passages (16). The through passages (16) have a cross-section based on a hexagonal shape (20) with alternating convex (24) and concave sides (26).

12 Claims, 2 Drawing Sheets

(56) References Cited

U.S. PATENT DOCUMENTS

| | | | | | |
|---|---|---|---|---|---|
| 4,150,717 | A | * | 4/1979 | Balke et al. | 165/9.1 |
| 4,303,599 | A | * | 12/1981 | Strigle et al. | 261/98 |
| 4,346,753 | A | * | 8/1982 | Kletch | 165/9.1 |
| 4,436,144 | A | | 3/1984 | Horak | |
| 4,474,504 | A | * | 10/1984 | Whitman et al. | 405/16 |
| 4,490,312 | A | * | 12/1984 | Furr | 261/98 |
| 4,597,238 | A | * | 7/1986 | Vadala' | 52/98 |
| 4,716,066 | A | * | 12/1987 | Wymann et al. | 428/116 |
| 4,874,034 | A | * | 10/1989 | Hirata et al. | 165/9.1 |
| 4,974,666 | A | * | 12/1990 | Hirata et al. | 165/9.1 |
| 5,087,150 | A | * | 2/1992 | McCreary | 405/31 |
| 5,127,463 | A | * | 7/1992 | Hirata et al. | 165/9.1 |
| 5,154,224 | A | * | 10/1992 | Yasui et al. | 165/9.1 |
| 5,200,119 | A | * | 4/1993 | Leva | 261/94 |
| 5,304,423 | A | * | 4/1994 | Niknafs et al. | 428/402 |
| 5,419,388 | A | * | 5/1995 | Hickel et al. | 165/9.3 |
| 5,429,451 | A | * | 7/1995 | Pettee, Jr. | 405/20 |
| 5,449,245 | A | * | 9/1995 | Glickman | 404/38 |
| 5,543,088 | A | * | 8/1996 | Halbirt | 261/94 |
| 5,556,228 | A | * | 9/1996 | Smith | 405/16 |
| 5,634,313 | A | * | 6/1997 | Mogling | 165/9.1 |
| 5,688,444 | A | * | 11/1997 | Koshy | 261/94 |
| 5,779,391 | A | * | 7/1998 | Knight | 405/20 |
| 5,890,836 | A | * | 4/1999 | Leech | 405/16 |
| 5,924,477 | A | | 7/1999 | Doru | |
| D414,276 | S | * | 9/1999 | Bruno et al. | D25/113 |
| 6,007,915 | A | * | 12/1999 | Rukovena | 428/397 |
| 6,079,902 | A | * | 6/2000 | Pettee, Jr. | 405/35 |
| D437,423 | S | * | 2/2001 | Lin | D25/114 |
| 6,302,188 | B1 | * | 10/2001 | Ruhl et al. | 165/9.3 |
| 6,508,042 | B1 | * | 1/2003 | Kweon et al. | 52/608 |
| 6,547,222 | B2 | * | 4/2003 | Blischak et al. | 165/10 |
| 6,746,177 | B1 | * | 6/2004 | Hoashi | 405/15 |
| D498,002 | S | * | 11/2004 | Ogawa et al. | D25/118 |
| 6,811,352 | B1 | * | 11/2004 | Meerkerk | 405/17 |
| 6,898,906 | B2 | * | 5/2005 | Drost | 52/177 |
| 6,938,382 | B2 | * | 9/2005 | Schmitz | 52/89 |
| 7,037,037 | B1 | * | 5/2006 | Smith et al. | 405/20 |
| 7,246,795 | B2 | * | 7/2007 | Niknafs et al. | 261/94 |
| D598,505 | S | * | 8/2009 | Sinisi et al. | D21/501 |
| D605,236 | S | * | 12/2009 | Sinisi et al. | D21/502 |
| 7,775,507 | B2 | * | 8/2010 | Niknafs et al. | 261/94 |
| D623,241 | S | * | 9/2010 | Ruble, IV | D21/488 |
| 7,862,013 | B2 | * | 1/2011 | Miller et al. | 261/94 |
| D641,803 | S | * | 7/2011 | Kichijo et al. | D21/489 |

FOREIGN PATENT DOCUMENTS

| | | |
|---|---|---|
| JP | 63230810 | 9/1988 |
| JP | 2004315921 | 11/2004 |
| RO | 107441 B1 | 11/1993 |

* cited by examiner

CHECKER BRICK WITH THROUGH PASSAGES FOR A HOT BLAST STOVE

TECHNICAL FIELD

The present invention generally relates to a checker brick, in particular refractory checker bricks used for recovering heat in recuperators, in particular in hot blast stoves.

BACKGROUND

In the metallurgical industry, the preheating of air for blast furnaces is conventionally carried out in adjacent regenerative heaters known as hot blast stoves. These stoves generally consist, for a stove with internal combustion chamber, of a cylindrical refractory wall and an internal vertical partition wall partitioning the stove into a combustion chamber and a checker chamber containing checker bricks or, for a stove with external combustion chamber, of two cylindrical refractory lined chambers with a connection dome. Air and fuel is introduced through one or two openings into a so-called ceramic burner or metallic burner in the combustion chamber for burning and the resultant combustion gasses flow upwardly from the combustion chamber over to the combustion chamber downwardly through the checker work chamber until they are finally exhausted at the base of that chamber. As the combustion gasses pass though the checker work chamber containing a plurality of checker bricks, heat from the combustion gasses is transferred to the checker bricks and retained therein. Once the checker bricks have reached a sufficiently high temperature, the direction of fluid flow in the stove is reversed. A cold blast is introduced at the base of the checker work chamber and is fed through the checker work chamber, where the cold blast absorbs heat from the checker bricks and passes over the partition wall and through the combustion chamber, where it leaves the stove through a hot blast outlet in the shell of the stove to be fed to the blast furnace.

Many different designs and arrangements of checker bricks have been designed over the years. An example of such a checker brick design can e.g. be seen in U.S. Pat. No. 4,436,144, which describes a checker brick having an octagonal outside contour and a central through passage of tetragonal cross-section. Furthermore, this brick has a substantially uniform wall thickness. Such bricks are preferably stacked in layers and staggered relative to each other. This results in a stack of checker bricks with vertical passages being formed for the gasses. In order to facilitate stacking of the checker bricks, they are provided with raised portions at the top surface of the brick and with corresponding recesses at the bottom surface of the brick.

Another example of such a checker brick design can e.g. be seen in U.S. Pat. No. 2,017,763, wherein an essentially square checker brick is provided with a plurality of through passages, each through passage being formed by a rectangular part and a tapered part. Due to the plurality of through passages, partition walls are being formed between the through passages. Compared to U.S. Pat. No. 4,436,144, these partition walls contribute to an increased strength of the checker brick. The plurality of through passages also allow to increase the total contact surface between the gas and the checker brick, thereby increasing the heating surface for a better heat exchange.

Checker bricks similar to the one disclosed in U.S. Pat. No. 2,017,763 have been suggested, wherein the through passages have circular, square or hexagonal cross-section, the latter being particularly preferred because they allow partition walls of substantially uniform thickness. Checker bricks of hexagonal cross-section are also commercially known as checker bricks of the GSI type.

BRIEF SUMMARY

The invention provides a further improved checker brick with better thermodynamic performance More particularly, the present invention proposes a checker brick, in particular for hot blast stove, the checker brick having a top surface and an opposite bottom surface, wherein a plurality of through passages extend from the top surface to the bottom surface for allowing fluids to circulate through the checker brick, partition walls being formed between neighbouring through passages. According to an aspect of the invention, the through passages have a cross-section based on a hexagonal shape having alternating convex and concave sides. This particular shape enables to increase the heating surface, i.e. the surface between the through passage and the checker brick, where heat transfer between the checker brick and the gas passing through the through passage occurs. With respect to hexagonal through passages, as e.g. present on the prior art checker bricks of the GSI type, the heating surface can be increased by approximately 40%. The reduced hydraulic diameter of the through passage leads to a bigger heat exchange coefficient. A nearly constant free cross-section is also achieved. A checker brick having through passages with such a cross-section hence has better thermodynamic performance.

Preferably, neighbouring through passages are arranged such that a concave side of one through passage faces a convex side of a neighbouring through passage. Neighbouring through passages are preferably arranged such that partition walls of substantially constant thickness are formed between neighbouring through passages. Substantially constant wall thickness allows a uniform heat transfer and, more importantly, a uniform heating up and cooling down of the partition walls themselves, thereby avoiding damages to the partition walls due to varying temperatures within the partition wall.

The concave sides can be formed with a curvature of a first radius; and the convex sides can be formed with a curvature of a second radius. The first radius can substantially correspond to the second radius. With the first and second radii being substantially the same, the convex $f(tx+(1-t)y)<f_{(x)}+(1-t)f_{(y)}$ and concave $f(tx+(1-t)y)>tf_{(x)}+(1-t)f_{(y)}$ sides of neighbouring checker bricks become complementary.

According to a preferred embodiment, the convex sides have two edge regions and a central region therebetween, wherein the concave sides are formed with a curvature of a first radius, the central regions of the convex sides are formed with a curvature of a second radius and the edge regions of the convex sides are formed with a curvature of a third radius, the third radius being smaller than the first and second radii. The third radius can e.g. be about half of the second radius. The smaller radius of the edge regions of the convex sides allows creating a smoother transition from the convex side to the concave side.

Advantageously, the through passages are tapered in a direction towards the top surface of the chequer brick.

Preferably, the chequer brick has substantially hexagonal cross-section, six side faces extending from the top surface to the bottom surface.

The side faces of the checker bricks are advantageously provided with channels having a cross-section corresponding to half the cross-section of a through passage; the channels being arranged in such a way that, when two neighbouring checker bricks are arranged side-by-side, the chambers of the side faces of the checker bricks form a through passage. The outer walls of the checker bricks hence also have an increased heating surface. Furthermore, additional through passages can be formed between two neighbouring checker bricks when arranged side-by-side. More importantly however, the outer walls of the checker bricks also have substantially constant thickness, just like the partition walls. Uniform heat transfer is hence also guaranteed in these outer walls.

According to a preferred embodiment of the invention, one of the top and bottom surfaces is provided with at least one raised portion, the other one of the top and bottom surfaces being provided with a corresponding at least one recess, the at least one raised portion and the at least one recess forming tongue and groove joints between stacked checker bricks. The at least one raised portion may comprise a central raised portion on the respective top or bottom surface. The central raised portion can have a cross-section with 3-fold rotational symmetry. The tongue and groove allows avoiding that checker bricks are incorrectly installed. Furthermore, the present tongue and groove configuration creates a bigger base area, which provides an improved creep-in-compression. As a consequence, checker bricks of lower quality material can be used to achieve comparable results, thereby reducing the costs of the checker bricks. The hot blast stove can be constructed smaller and lighter, which will reduce material cost and shorten erection time, without however reducing the performance of the hot blast stove.

Furthermore, the at least one raised portion preferably comprises peripheral raised portions in corner regions of the respective top or bottom surface, the peripheral raised portions being dimensioned and arranged so as to be complementary to peripheral raised portions of neighbouring checker bricks. The peripheral raised portions can be dimensioned and arranged so as to have a cross-section corresponding to the cross-section of the central raised portion. Central raised portions can interact with peripheral recesses, whereas peripheral raised portions can interact with central recesses. It follows that such a configuration of raised portions and recesses enables the staggered stacking of checker bricks. Due to the shape of the raised portions and recesses, it is ensured that the checker bricks are always correctly arranged.

It should also be noted that, in the present document, the term "concave" is to be understood to have the mathematical meaning of "strictly concave", thereby excluding the straight line. Similarly, the term "convex" is to be understood to have the mathematical meaning of "strictly convex", thereby excluding the straight line.

BRIEF DESCRIPTION OF THE DRAWINGS

The present invention will be more apparent from the following description of one not limiting embodiment with reference to the attached drawings, wherein the figures show.

DETAILED DESCRIPTION

Figure 1:
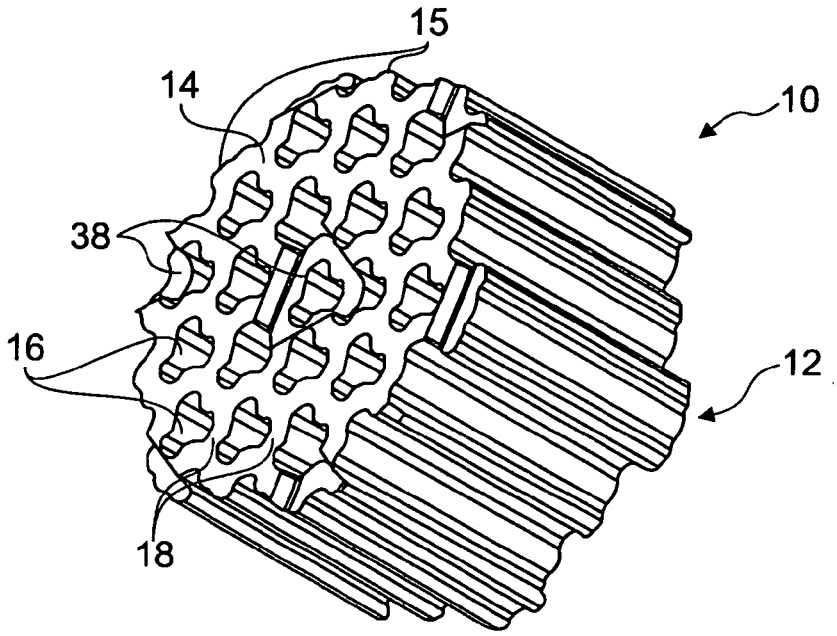
FIG. 1: a perspective view of a checker brick according to the invention.

FIG. 1 shows a checker brick 10 according to the invention. The checker brick 10 is of substantially hexagonal cross-section and has a top surface 12, an opposite bottom surface 14 and six side faces 15 extending from the top surface 12 to the bottom surface 14. The checker brick is provided with a plurality of through passages 16 extending from the top surface 12 to the bottom surface 14 for allowing fluids to circulate through the checker brick 10, partition walls 18 being formed between neighbouring through passages 16. The through passages 16 have a particular cross-section, which can be more closely described by referring to FIG. 2.

Figure 2:
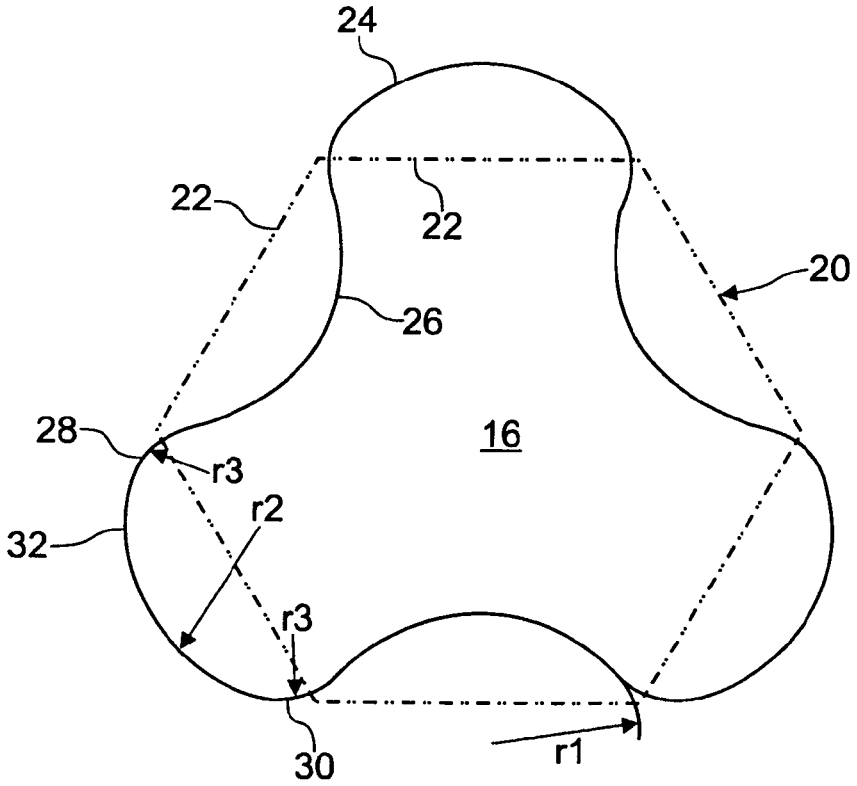
FIG. 2: a cross-section of a through passage of the checker brick of FIG. 1.

FIG. 2 illustrates the cross-section of a through passage 16. This cross-section is based on a hexagonal shape, as represented by dotted lines 20, wherein however the straight sides 22 of the hexagon have been transformed to alternating convex sides 24 and concave sides 26. The concave sides 26 are formed with a curvature of a first radius r1 and the convex sides 24 are generally formed with a curvature of a second radius r2. According to the particular embodiment shown in FIG. 2, the convex side 24 comprises two edge regions 28, 30 and a central region 32 therebetween, the central regions 32 of the convex sides 24 being formed with a curvature of a second radius r2 and the edge regions 28, 30 of the convex sides 24 being formed with a curvature of a third radius r3, wherein the third radius r3 is smaller than the second radius T2. Preferably the third radius r3 is about half of the second radius r2. Furthermore, the first radius r1 is advantageously substantially identical to the second radius r2. Advantageously, the radii are chosen such that there is a smooth transition between convex and concave sides 24, 26.

The shape of the cross-section of the through passages 16 may also be described as being a closed organic shape having six inflection points, each of these inflection points lying on a corner of a hexagonal shape.

Figure 3:
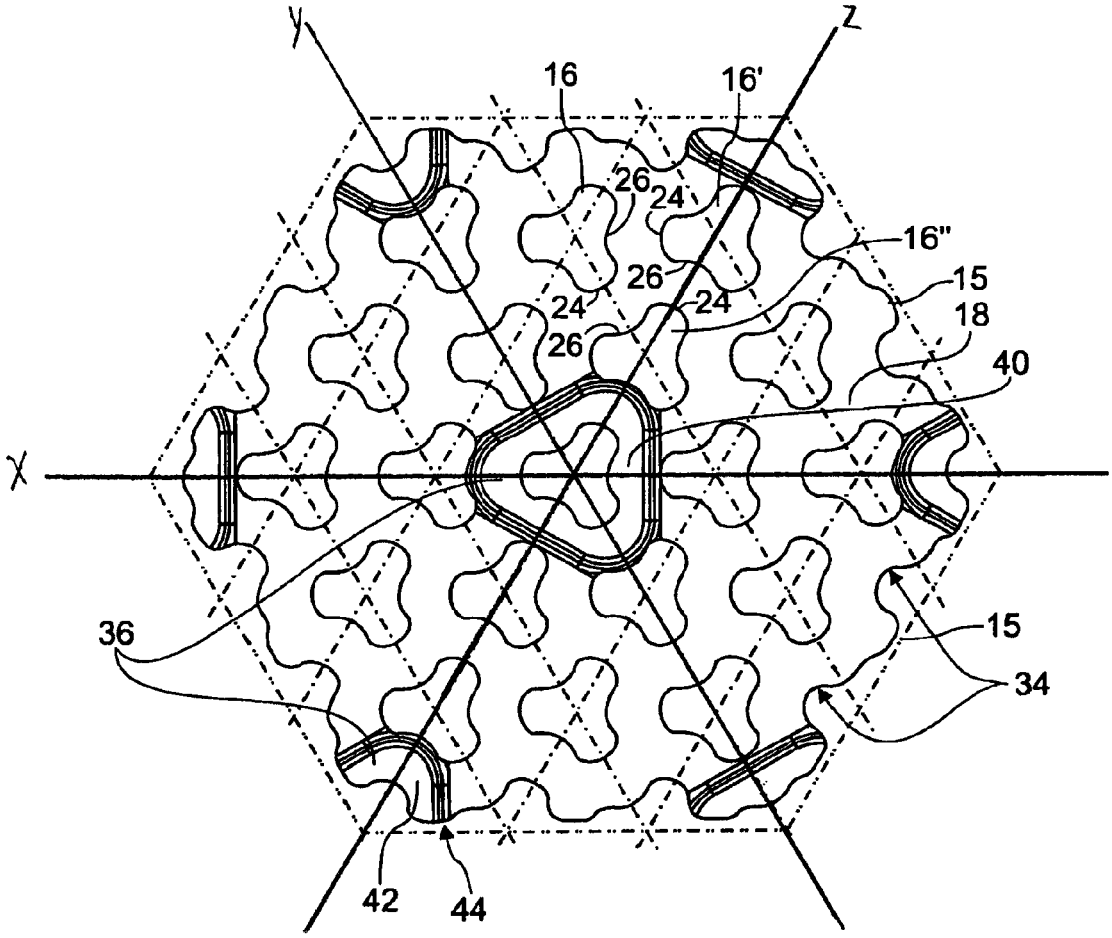
FIG. 3: a top view on the top surface of the checker brick of FIG. 1.

FIG. 3 shows a top view of the checker brick of FIG. 1 wherein the arrangement of through passages 16 with respect to each other can clearly be seen. Neighbouring through passages 16, 16', 16" are arranged in such a way that a concave side 26 of one through passage faces a convex side 24 of a neighbouring through passage. Furthermore, the arrangement is such that partition walls 18 between neighbouring through passages 16, 16', 16" are of substantially constant thickness.

As can also be seen on FIG. 3, the side faces 15 of the checker brick 10 are provided with channels 34 having a cross-section corresponding to half the cross-section of a through passage 16. These channels 34 are arranged such that, when two neighbouring checker bricks 10 are arranged side-by-side, the chambers 34 of the touching side faces 15 of neighbouring checker bricks 10 form a through passage 16.

Although not seen on the figures, the through passages 16 are tapered in a direction towards the top surface 12 of the chequer brick 10, i.e. the cross-section of the through passage 16 at the bottom surface 14 is bigger than the cross-section of the through passage 16 at the top surface 12.

Tongue and groove joints are provided for improving the stacking capabilities of the checker bricks 10. As seen in FIGS. 1 and 3, the top surface 12 of the checker brick 10 is provided with raised portions 36, whereas the bottom surface 14 of the checker brick 10 is provided with corresponding recesses 38. The hexagonal checker brick 10 of FIG. 3 is shown to comprise a central raised portion 40 having a cross-section with 3-fold rotational symmetry wherein the central raised portion 40 is symmetrical about an x-axis, a y-axis, and a z-axis, each of the axes passing through the checker brick 10, thereby ensuring correct orientation of the stacked checker bricks. This central raised portion 40 is arranged around a central through passage 16, which is surrounded by six neighbouring through passages 16. The central raised portion 40 has a generally triangular cross-section, wherein the corner regions of the triangle are rounded off to conform to the curvature of the concave sides 26 of the three neighbouring checker bricks having their concave sides 26 facing the central checker brick.

In addition to the central raised portion 40, the hexagonal checker brick 10 of FIG. 3 comprises peripheral raised portions 42 in corner regions 44 of the top surface 12. The peripheral raised portions 42 have a cross-section corresponding to a third of the cross-section of a central raised portion 40 and are arranged such that, when three neighbouring checker bricks 10 are arranged side-by-side, the peripheral raised portions 42 of neighbouring checker bricks 10 form a raised portion corresponding to the central raised portion 40. This allows correct orientation of the checker bricks stacked in a staggered configuration. As can be seen on FIG. 1, without however being described herein in detail, the bottom surface 14 of the checker brick 10 comprises a central recess and peripheral recesses.

It should also be noted that the raised portions 36 may also be provided on the bottom surface 14 if the recesses 38 are provided on the top surface 12.

The invention claimed is:

1. A checker brick comprising: a top surface; an opposite bottom surface;

a plurality of through passages extending from the top surface to the bottom surface configured for allowing fluids to circulate through the checker brick; and plurality of, partition walls formed between neighboring through passages, wherein each of said through passages has a cross-section with a hexagonal shape consisting of a plurality of concavely curved sides and convexly curved sides, the six sides arranged in an alternating configuration such that each of said convexly curved sides is adjacent to at least one concavely curved side, wherein adjacent through passages are arranged such that each concave side of one through passage faces a convex side of the adjacent through passage, wherein neighboring through passages are arranged such that partition walls of constant thickness are formed between neighboring through passages.

2. The checker brick according to claim 1, wherein:

said concave sides are formed with a curvature of a first radius (r1); and said convex sides are formed with a curvature of a second radius (r2).

3. The checker brick according to claim 2, wherein the length of said first radius (r1) is equal to the length of said second radius (r2).

4. The checker brick according to claim 1, wherein said convex sides have two edge regions and a central region therebetween, and wherein:

said concave sides are formed with a curvature of a first radius (r1); and said central regions of said convex sides are formed with a curvature of a second radius (r2) and said edge regions of said convex sides are formed with a curvature of a third radius (r3), said third radius (r3) being smaller than said first and second radius (r2).

5. The checker brick according to claim 4, wherein said chequer brick has hexagonal cross-section, six side faces extending from said top surface to said bottom surface.

6. The checker brick according to claim 5, wherein said side faces of the checker bricks are provided with channels having a cross-section wherein the length is equal to half the length of the cross-section of a through passage.

7. The checker brick according to claim 5, wherein said at least one raised portion comprises a central raised portion on said respective top or bottom surface and wherein said central raised portion has a cross-section with 3-fold rotational symmetry, wherein the central raised portion 40 is symmetrical about an x-axis, a y-axis, and a z-axis.

8. The checker brick according to claim 1, wherein the length of said first radius (r1) is equal to the length of said second radius (r2).

9. The checker brick according to claim 1, wherein the length of said third radius (r3) is equal to half the length of said second radius (r2).

10. The checker brick according to claim 1, wherein one of said top and bottom surfaces is provided with at least one raised portion having a central raised portion on said respective top or bottom surface.

11. The checker brick according to claim 10, wherein said peripheral raised portions are configured such that the length of a cross-section is equal to the length of the cross-section of said central raised portion and wherein said at least one raised portion comprises peripheral raised portions in corner regions of said respective top or bottom surface, said peripheral raised portions being dimensioned and arranged so as to be corresponding to peripheral raised portions of adjacent checker bricks.

12. The checker brick according to claim 1, wherein one of said top and bottom surfaces is provided with at least one raised portion having peripheral raised portions in corner regions of said respective top or bottom surface, said peripheral raised portions being dimensioned and arranged so as to be corresponding to peripheral raised portions of adjacent checker bricks.

* * * * *